United States Patent [19]

Walters et al.

[11] 4,031,813

[45] June 28, 1977

[54] HYDRAULIC ACTUATOR CONTROLS

[75] Inventors: Ronald Bernard Walters, Wembley; Peter Michael Hamey, Emsworth; John Anthony Gordon Hammond, Guildford; Thomas Derek Lindon, Ashtead, all of England

[73] Assignee: Sperry Rand Limited, London, England

[22] Filed: Oct. 3, 1974

[21] Appl. No.: 511,739

[30] Foreign Application Priority Data

Oct. 10, 1973 United Kingdom ..... 47213/73

[52] U.S. Cl. ..... 91/433

[51] Int. Cl.[2] ..... F15B 11/10; F15B 13/043

[58] Field of Search ..... 91/433

[56] References Cited

UNITED STATES PATENTS

| | | | |
|---|---|---|---|
| 2,909,195 | 10/1959 | Keyt | 91/433 X |
| 3,125,856 | 3/1964 | Brandson et al. | 91/433 |
| 3,354,716 | 11/1967 | Wiebe et al. | 72/228 X |
| 3,589,387 | 6/1971 | Raymond | 251/367 X |
| 3,686,557 | 8/1972 | Futamura | 323/19 X |
| 3,727,520 | 4/1973 | McKown et al. | 91/433 |
| 3,732,887 | 5/1973 | Hayner | 91/433 X |
| 3,741,073 | 6/1973 | Garnjost | 91/433 X |
| 3,751,940 | 8/1973 | Norbeck | 318/599 X |
| 3,763,746 | 10/1973 | Walters | 91/433 |
| 3,782,250 | 1/1974 | Kiszewski | 91/433 |
| 3,870,931 | 3/1975 | Myers | 318/599 X |
| 3,895,287 | 7/1975 | Sun et al. | 323/20 |

FOREIGN PATENTS OR APPLICATIONS 1,085,921 10/1967 United Kingdom

*Primary Examiner*—Irwin C. Cohen

*Attorney, Agent, or Firm*—Barnes, Kisselle, Raisch & Choate

[57] ABSTRACT

A device for controlling a hydraulic actuator comprises two servo loops having in common a fluid pressure operated main valve and an electrically operated pilot valve for controlling the main valve. One of the servo loops is for flow control and contains a flow transducer for producing an electrical feedback signal responsively to fluid flow to the actuator and a comparator for comparing the flow feedback signal with a first electrical input signal. The other servo loop is for force control and contains pressure transducing means for producing an electrical feedback signal responsively to the pressure drop across the actuator and a second comparator for comparing the force feedback signal with a second electrical input signal.

25 Claims, 9 Drawing Figures

--FIG.1--
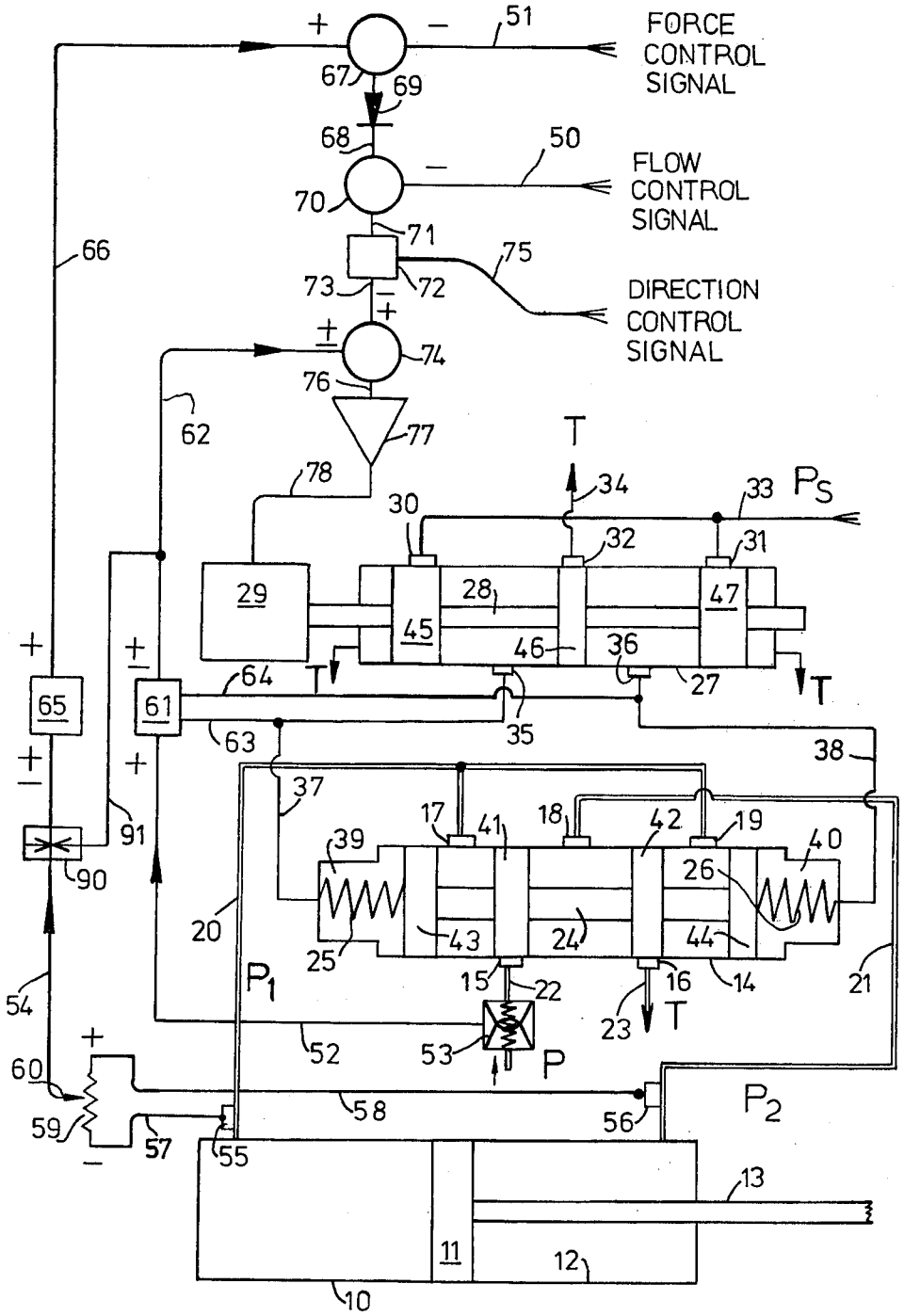

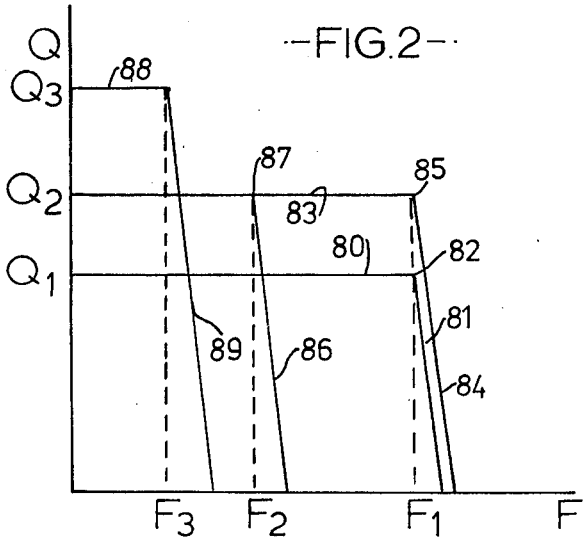
-FIG.2-
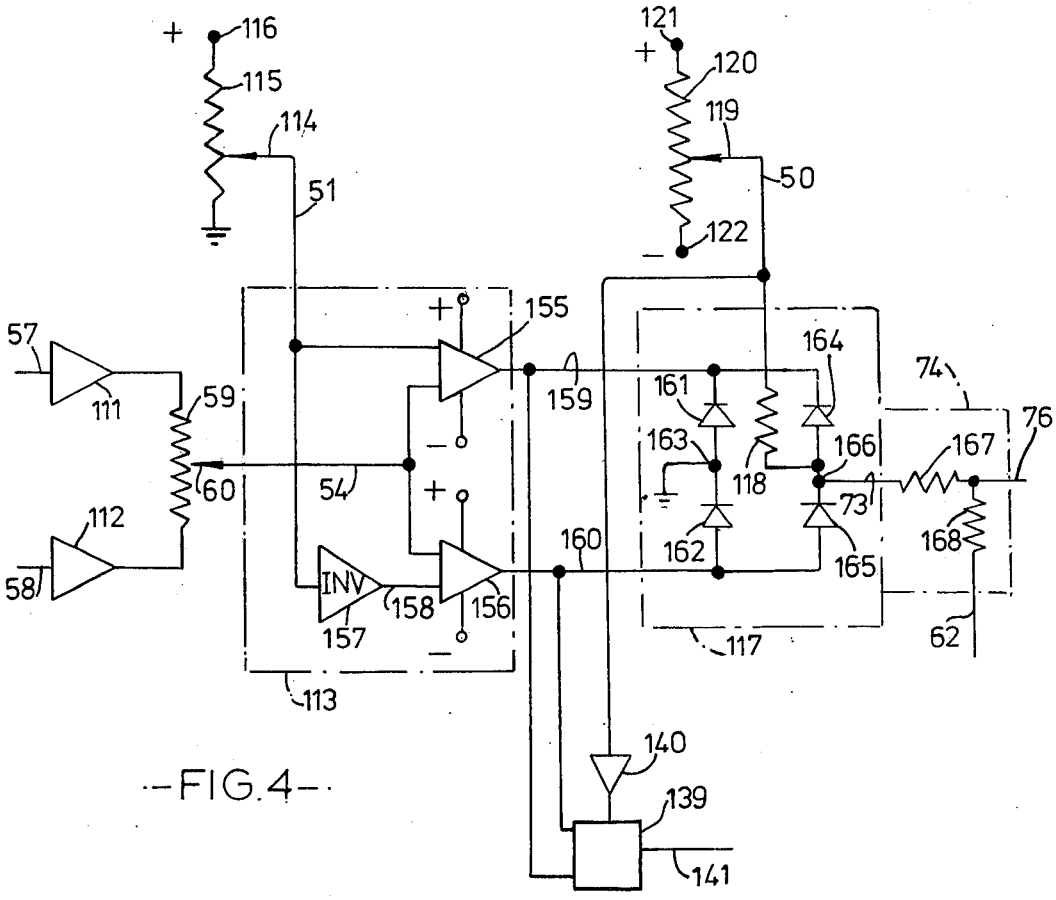
-FIG.4-

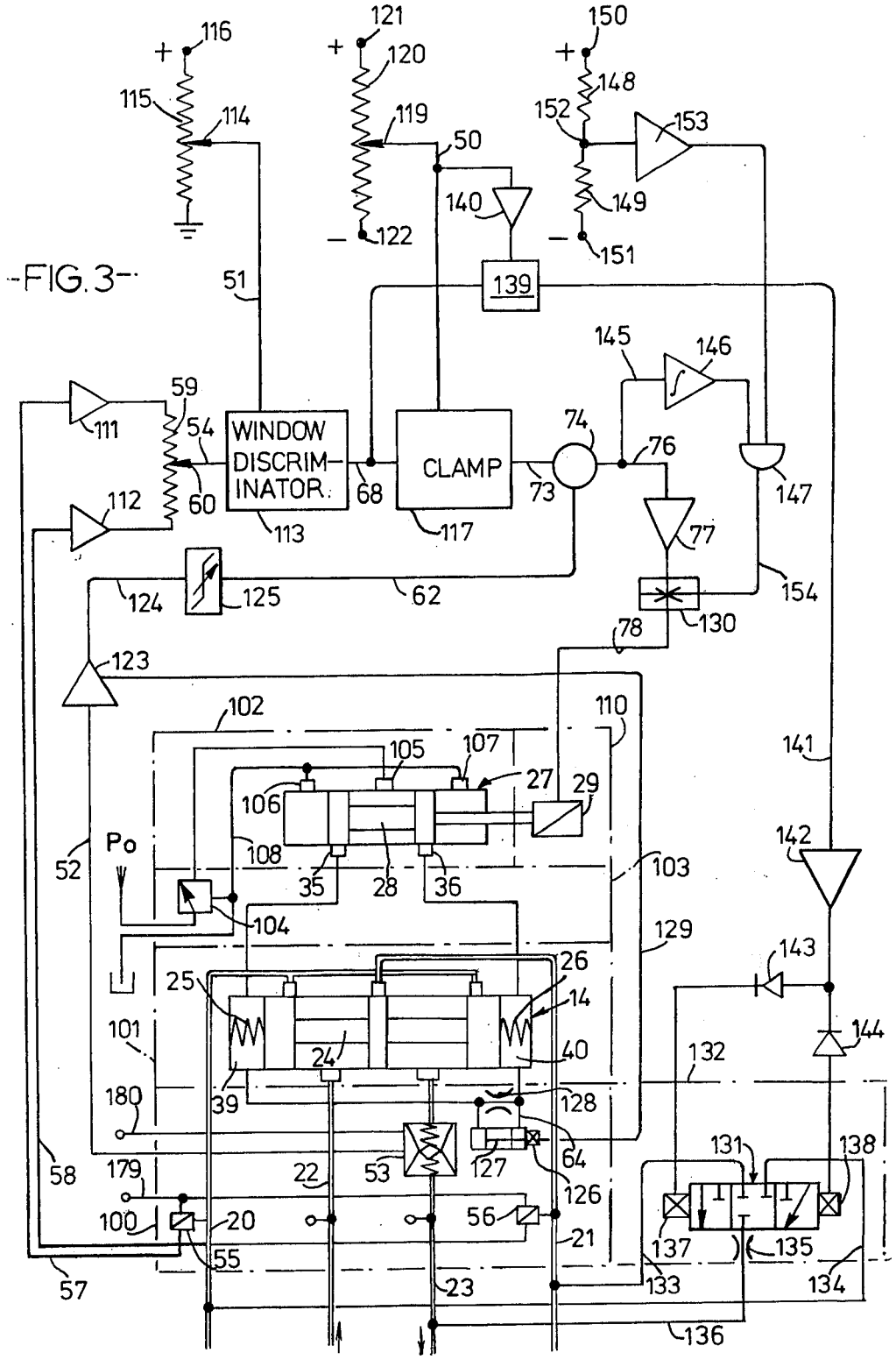
-FIG. 3-

—FIG.5—
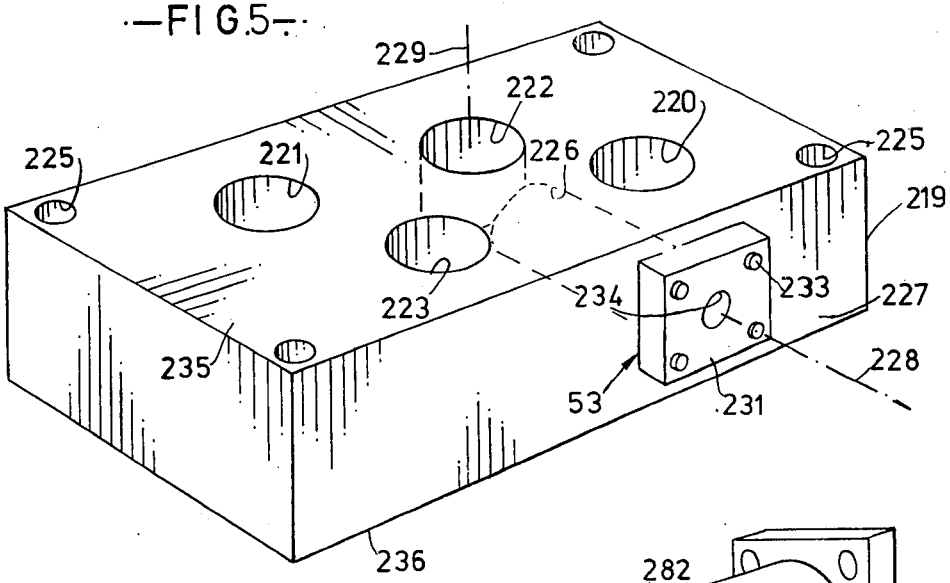
—FIG.6—
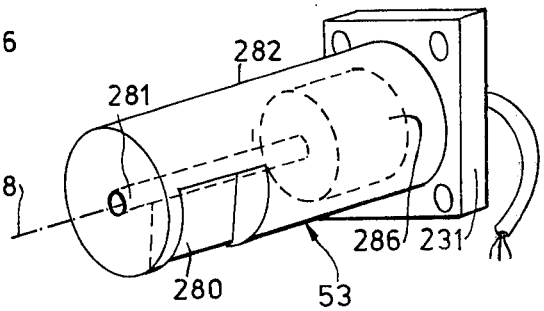

—FIG.7—
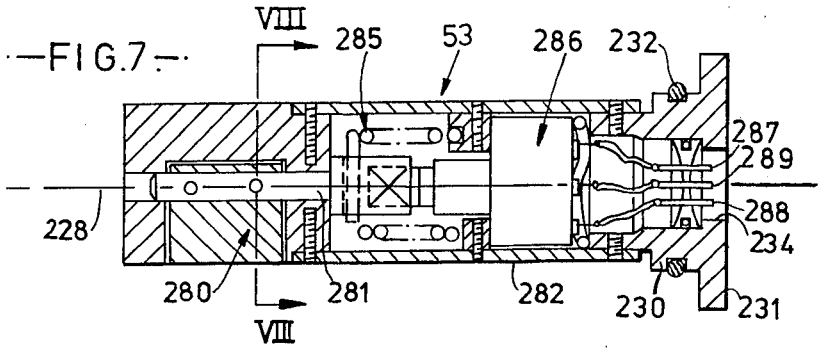
—FIG.8—
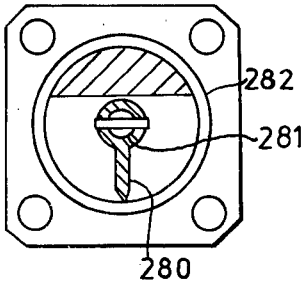
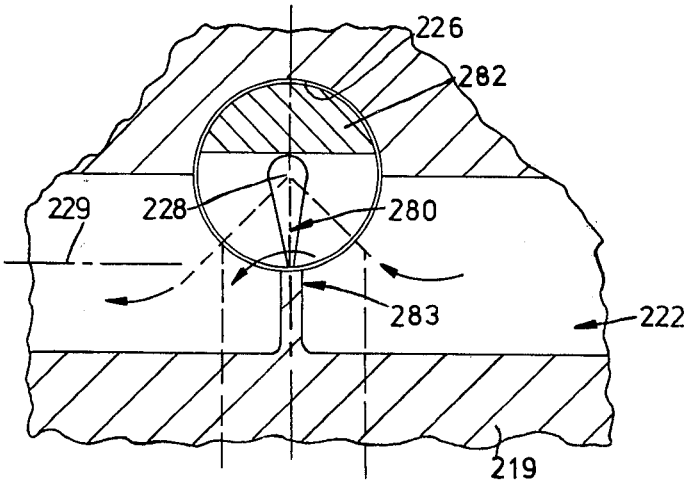
—FIG.9—

HYDRAULIC ACTUATOR CONTROLS

This invention relates to hydraulic actuator controls.

The invention provides a device for controlling the flow of fluid to hydraulic actuator means, comprising a fluid pressure operated main valve for regulating the fluid flow to the actuator means; a pilot valve for controlling the main valve; electrical input means for an electrical input signal; flow sensing means for producing an electrical feedback signal dependent on the rate of fluid flow to the actuator means; and means for comparing said feedback signal with said input signal and for operating said pilot valve accordingly.

Preferably the device additionally comprises second electrical input means for a second electrical input signal, pressure sensing means for producing a second electrical feedback signal responsively to the pressure difference across the actuator means and thereby dependently upon the load on the actuator means, and means for comparing said second feedback signal with said second input signal and for operating said pilot valve accordingly. This, the device preferably has two modes of operation. In the so-called flow control mode, the pilot valve, and thereby the main valve, are controlled in accordance with the fluid flow to the actuator means, and in the so-called force control mode, the pilot valve, and thereby the main valve, are controlled in accordance with the load upon the actuator means, i.e. the force applied by or to the actuator means.

Thus, it will be seen that the device of the present invention contains a flow control servo loop which includes the pilot valve, the main valve and an electrical feedback from the flow sensing means to the means for comparing the first feedback signal with the first input signal. Also, in the preferred embodiment, the device contains a second servo loop of which a part containing the pilot valve and the main valve is common with the corresponding part of the first servo loop for flow control. The second servo loop for force control has an electrical feedback from the pressure sensing means to the means for comparing the second-feedback signal with the second electrical input signal.

Conveniently, the pressure sensing means comprises two pressure transducers, one connected to each side of the actuator means. The output signals from the two transducers can be processed unsymmetrically in order that the electrical feedback signal can take into account any unsymmetry of the hydraulic actuator means and hence provide true control of actuator force.

The device in accordance with preferred embodiments of the invention lends itself to modular construction. Thus the main and pilot valves can be in separate valve blocks. A pressure reducing valve serving to provide pilot fluid for the pilot valve is conveniently in a port plate between the main and pilot blocks. The flow sensing and pressure sensing means are advantageously installed in a port plate on which the main valve block is mounted.

The invention is further described, by way of example, with reference to the accompanying drawings, in which:

FIG. 1 is a combined hydraulic and block electrical circuit diagram of a hydraulic actuator control device constructed in accordance with one embodiment of the invention;

FIG. 2 is a graph in which the fluid flow Q to the actuator is plotted against the load F upon the actuator in various operating modes;

FIG. 3 is a combined hydraulic and block electrical circuit diagram of a control device constructed in accordance with a second embodiment of the invention;

FIG. 4 is a part of the electrical circuitry of the device of FIG. 3 drawn somewhat more fully;

FIG. 5 is a perspective view of a port plate in which a flow sensor of a control device in accordance with the invention is fitted;

FIG. 6 is a perspective view of one embodiment of flow sensor as fitted to the port plate of FIG. 5;

FIG. 7 is a longitudinal section of the flow sensor of FIG. 6;

FIG. 8 is a section of the line VIII—VIII of FIG. 7; and

FIG. 9 is a sectional view showing the flow sensor of FIGS. 6 to 8 in the flow passage of the port plate of FIG. 5.

The device illustrated in FIG. 1 serves for controlling a double-acting hydraulic actuator 10 comprising a piston 11 slidable in a cylinder 12. A piston rod 13 extends out of one end of the cylinder 12. A main valve 14 is provided with inlet and drain ports 15 and 16 and service ports 17, 18 and 19. The service ports 17 and 19 are connected via a service line 20 to the lefthand end of the actuator cylinder 12 and the medial service port 18 is connected by a service line 21 to the righthand end of the actuator cylinder 12. Hydraulic fluid at a pressure P is fed via a supply line 22 to the inlet port 15 and the drain port 16 is connected to tank via a line 23.

The main valve 14 is fluid pressure operated and its valve spool 24 is biased to neutral by springs 25 and 26. The main valve 14 is controlled by a pilot valve 27 whose valve spool 28 is operated by a double acting force motor 29. The force motor 29 serves to move the spool 28 in one direction or the other from the central neutral position against a spring bias produced by springs (not shown) inside the force motor 29. The spool 28 is shown in its neutral position which is adopted when the force motor 29 is not energized. The chambers at the ends of the spool 28 are connected to tank. The pilot valve 27 has input ports 30 and 31, to which a control fluid at a pressure $P_S$ is supplied via a line 33, and a medical drain port 32 connected by a line 34 to tank. Output ports 35 and 36 of the pilot valve 27 are connected via control lines 37 and 38 to control chambers 39 and 40 at opposite ends of the main valve 14. Thus, fluid pressure in the control chamber 39 acts upon the lefthand end of the main valve spool 24 to urge the spool 24 rightwards and control pressure in the chamber 40 acts upon the righthand end of the spool 24 to urge it leftwards. When the pressures in the chambers 39 and 40 are equal the spool 24 is biased to its neutral position by the springs 25 and 26.

The main valve spool 24 has lands 41 and 42, which substantially close off the ports 15 and 16 in the neutral position, and has end pistons 43 and 44 exposed to the control chambers 39 and 40, respectively. The ports 17, 18 and 19 communicate respectively with the three spaces formed between the piston 43, the land 41, the land 42 and the piston 44. The pilot valve 27 has lands, 45, 46 and 47 which substantially close off the ports 30, 32 and 31 in the neutral position. The ports 35 and 36 communicate respectively with two spaces defined between the lands 45, 46 and 47.

The control device illustrated in FIG. 1 is provided with two electrical inputs and two electrical feedbacks. An electrical flow control signal is provided on a lead 50 and an electrical force control signal is applied on a lead 51. An electrical flow feedback signal is applied to a lead 52 by a flow sensor 53 which in the illustrated embodiment is inserted in the supply line 22. An electrical force feedback signal is provided on a lead 54 by pressure sensing means comprising pressure transducers 55 and 56 connected respectively to the service lines 20 and 21. So that the signal on the lead 54 shall represent the force applied by or to the actuator 10 rather than merely the difference between the pressure $P_1$ and $P_2$ at opposite sides of the actuator 10, leads 57 and 58 from the pressure transducers 55 and 56 are connected with opposite polarity to opposite ends of a potentiometer 59. The slider 60 of the potentiometer 59 is connected to the lead 54 and can be adjusted away from its mid-position on the potentiometer in order to compensate for the differences in effective cross-sectional area of the two sides of the actuator piston 11, and thereby produce a signal indicative of the actual force on the piston rod 13. In the illustrated embodiment the righthand side of the piston 11 is of slightly smaller effective area than the lefthand side due to the piston rod 13 extending out of the actuator cylinder 12.

The flow feedback signal on the lead 52 is applied via a reversing switch 61 to a lead 62. The switch 61 is pressure responsive and is connected by lines 63 and 64 to the main valve control chambers 39 and 40, the lines 63 and 64 being illustrated as actually being connected to the control lines 37 and 38. The switch 61 may be an electronic switch responsive to the electrical output of a pressure transducer connected between the lines 63 and 64. The switch 61 is effectively responsive to the direction of actuator movement since the direction of actuator movement is determined by the direction of displacement of the main spool 44 from its neutral position which in turn is dependent upon which of the two control chambers 39 and 40 is at a higher pressure. Since the flow sensor 53 is in the supply line the flow feedback signal is of the same polarity, for example, positive, in whichever direction the actuator is moving. If the actuator is moving in one direction the flow feedback signal is applied to the lead 62 with the same polarity by the switch 61. When the actuator is moving in the other direction the polarity of the flow feedback signal is reversed by the switch 61.

The force feedback signal on the lead 54 is applied via a clamp 90 and a signal rectifier 65 to a lead 66. The clamp 90 is operated via a lead 91 by a comparison of the polarity of the flow feedback signal on the lead 62 with the polarity of the force feedback signal on the lead 54. the polarity of the force feedback signal on the lead 54 is dependent upon which of the two sides of the actuator is at the higher pressure, but is not necessarily dependent upon the direction of actuator movement since the load could be moving against the actuator. The signal rectifier 65 thereby serves to transfer the pressure feedback signal directly from the lead 54 to the lead 66 when the signal is of one polarity, for example, positive, and to reverse the polarity of the signal on the lead 54 when this is of the opposite polarity.

The force control input lead 51 and the rectified force feedback lead 66 are connected to a force comparator 67 whose output is connected via a lead 68 containing a rectifier 69 to an adder 70 to which the flow control lead 50 is connected. The output of the adder 70 is connected by a lead 71 to a reversing switch 72 whose output is connected by a lead 73 to a flow comparator 74 to which the switched flow feedback line 62 is also connected. A direction control signal is applied by suitable means 75 to the reversing switch 72. The output of the flow comparator 74 is conneccted by a lead 76, an amplifier 77 and a lead 78 to the force motor 29 of the pilot valve 27.

Let us suppose now that it is desired to operate the device in the flow control mode with a pre-set level force override and that it is desired to move the piston 11 of the actuator 10 to the right. A negative electrical signal corresponding to the desired nominal maximum force is applied to the lead 51. So long as this negative signal is greater in magnitude than any positive signal on the lead 66 a negative signal appears at the output of the force comparator 67, and this negative signal is blocked by the rectifier 69. Another negative electrical signal is applied to the lead 50 with a magnitude denoting the desired rate of flow of fluid to the actuator piston 11, such rate of flow being proportional to the velocity of the load being moved by the actuator. This negative signal is passed via the adder 70 and the lead 71 to the switch 72. If it is supposed that the appropriate direction control signal applied to the means 75 sets the switch 72 so that the signal from the adder 70 is not reversed in polarity, this negative signal is applied directly to the flow comparator 74, where it is compared with a positive polarity feedback signal as will be described hereinafter. An error signal corresponding to the difference in magnitudes between the flow control signal and the flow feedback signal appears at the output of the comparator 74. The comparator 74 can be simply regarded as an adder so that if the negative control signal is greater than magnitude than the positive polarity feedback signal the resulting error signal on the lead 76 is also negative. This error signal is amplified by the amplifier 77 and applied via the lead 78 to the force motor 29 with a polarity to displace the pilot spool 28 to the left. The inlet port 30 is then connected to the port 35 and the port 36 likewise is connected to the drain port 32 whereby the pressure in the control chamber 39 of the main valve 14 is increased and that in the chamber 40 is descreased. The main valve spool is thereby displaced to the right to place the inlet port 15 in communication with the service port 17 and the service port 18 in communication with the drain port 16. Fluid then flows to the lefthand end of the actuator cylinder 12 and flows out of the righthand end to displace the piston 11 to the right. Since the hydraulic fluid flowing into the actuator flows through the flow sensor 53 a positive signal appears on the lead 52. The direction of pressure difference between the lines 63 and 64 controlling the reversing switch 61 is indicative of the direction of the piston travel as described above and is such that when the piston 11 is moving to the right and the pressure in the line 63 is, therefore, higher than the pressure in the line 64, the switch 61 does not reverse the polarity of the flow feedback signal. The positive polarity flow feedback signal is then applied by the lead 62 to the flow comparator 74 as mentioned above. It it is desired that the piston 11 should move to the left the direction control signal applied to the means 75 operates the reversing switch 72 so that the polarity of the signal applied to the flow comparator 74 is reversed. The pilot spool 28 is thereby displaced to the right and the main spool 24 to the left to achieve the desired direction of movement of the piston 11. The pressure in the line 64 is now higher than the pressure in the line 63 so that the reversing switch 61 reverses the polarity of the flow feedback signal whereby the feedback signal on the lead 62 is a negative polarity signal to be added in the comparator 74 to the flow control signal made positive by the switch 72. Assuming that the amplifier 77 has a very high gain the velocity of the piston 11 in the steady state is proportional to the magnitude of the flow control signal applied to the lead 50 but for an unsymmetrical actuator the rate of proportionality is different for the two directions of movement of the piston 11.

So far it has been assumed that, whichever the direction of movement of the actuator piston 11, the force feedback signal on the lead 54 produces on the lead 66 a positive polarity feedback signal smaller in magnitude than the control signal on the lead 51. It may be supposed that a pressure $P_1$ at the lefthand side of the actuator greater than the pressure $P_2$ at the righthand side produces a negative signal on the lead 54 and vice versa. However, the signal rectifier 65 ensures that whichever of the pressures $P_1$ and $P_2$ is the higher the feedback signal on the lead 66 is always of positive polarity and of a magnitude indicative of the force applied by or to the actuator. If the load encountered by the actuator is such that the magnitude of the force feedback signal becomes greater than the magnitude of the force control signal on the lead 51, a positive error signal appears at the output of the force comparator 67. The comparator 67 can also be regarded as an adder which adds the negative input signal to the positive polarity feedback signal. This positive error signal is passed by the rectifier 69 to the adder 70, thereby diminishing the magnitude of the negative flow control signal as applied via the lead 71, the reversing switch 72 and the lead 73 to the flow comparator 74. The effect of this is to reduce the flow of fluid to the actuator to relieve the actuator load. In other words, the force control now overrides the flow control to an increasing extent as the load on the actuator increases above that corresponding to the nominal maximum force as set by the signal applied to the lead 51.

The above operation is illustrated by the graph shown in FIG. 2 of the drawings. In the graph, the quantity Q of fluid flowing to the actuator 10 as measured by the flow sensor 53 is plotted against the force F applied by or to the actuator 10 as measured by the transducers 55 and 56 and the potentiometer 59. The substantially horizontal line 80 represents the value of the rate of flow $Q_1$ to the actuator when operating in the flow control mode so long as the load upon the actuator is below the predetermined value $F_1$ set by the force control signal. If the load on the actuator should reach the nominal maximum $F_1$ as set by the force control signal the force control begins to override the flow control and the flow Q is reduced from the point 82 along the near vertical line 81 as the force increases slightly above the predetermined value $F_1$. To operate the device with an increased fluid flow $Q_2$, the flow control signal is correspondingly increased in value and the device operates along the horizontal line 83 above and parallel to the line 80. Should the load on the actuator rise above the force $F_1$ corresponding to the force control signal the flow Q falls along the line 84 from the point 85. If it is desired to reduce the maximum force override the force control signal is correspondingly reduced so that when the actuator load reaches the value $F_2$, the flow Q falls along the line 86 from the point 87.

When the device is operating along one of the near vertical lines 81, 84 and 86, for example, it is effectively operating in the force control mode. Thus, to use the device in the force control mode, the force control signal is appropriately set at a nominal value $F_3$ and the flow control signal is set at a relatively high value $Q_3$ as represented, for example by the horizontal line 88 well above the lines 80 and 81 so that the rate of flow Q to the actuator takes place along the line 89.

Thus it will be appreciated that the two modes of operating the device are closely interrelated and the actual mode in which the device is operating will depend upon the values Q and F of the flow control and force control signals in relation to the load upon which the actuator is operating.

The force control is rendered inoperative by the polarity-selective clamp 90 when the load is overrunning the actuator. The clamp 90 is energised when pressure polarity is opposite to flow direction owing to overrun.

FIGS. 3 and 4 of the drawings illustrate a preferred embodiment of control device in which parts like those of FIGS. 1 and 2 are denoted by like reference numerals. As shown in FIG. 3 the flow sensor 53 and the pressure transducers 55 and 56 are installed in a port plate 100 on which a valve block 101 containing the main valve 14 is mounted. The pilot valve 27 is contained in a valve block 102 mounted via an intermediate port plate 103 on the main valve block 101. The intermediate port plate 103 contains a pressure reducing valve 104 which supplies control fluid to a medial inlet port 105 of the pilot valve 27. Outlet ports 106 and 107 of the pilot valve 27 are connected to drain via a line 108 passing through the intermediate port plate 103. The force motor 29 is contained in a housing 110 attached to the pilot valve block 102.

Electrical power for pressure transducers is supplied via leads 179. The outputs from the pressure transducers 55 and 56 are fed via the leads 57 and 58 and preamplifiers 111 and 112 to the potentiometer 59. The tapping 60 on which the force feedback signal appears is connected to a force comparator in the form of a window discriminator 113 to which the force control signal is applied via the lead 51. As shown the lead 51 leads from the tapping 114 of a potentiometer 115, one end of which is connected to a positive terminal 116 and whose other end is earthed. The force control signal, therefore, varies from zero to a maximum positive valve as the desired actuator force is increased from zero to a maximum.

The window discriminator 113 replaces the signal rectifier 65, the adder 67 and the reactifier 69 of FIG. 1. So long as the force feedback signal on the lead 54 is less in magnitude than the force control signal on the lead 51 no longer appears on the lead 68. As soon as the magnitude of the force feedback signal exceeds the magnitude of the force control signal, the window discriminator applies an error signal to the lead 68. In this embodiment the polarity of the error signal is opposite to the polarity of the force feedback signal.

The output of the discriminator 113 is connected via the lead 68 to a clamp 117. The flow control signal appearing on the lead 50 is also applied to the clamp 117. The lead 50 lead from the tapping 119 of a potentiometer 120, one end of which is connected to a positive terminal 121 and the other end of which is connected to a negative terminal 122. The flow control signal is thereby variable from a positive maximum to a negative maximum depending upon the desired flow of fluid to the actuator and desired direction of movement of the actuator. So long as there is no error signal on the lead 68, the clamp 117 passes the flow control signal on the lead 50 directly to the lead 73. The clamp is so constructed that, if a negative error signal appears on the lead 68 when the flow control signal on the lead 50 is positive, the previously positive signal on the lead 73 tends to zero. Likewise, if a positive error signal appears on the lead 68 when the flow control signal on the lead 50 is negative, the previously negative signal on the lead 73 tends to zero. The clamp 117 ignores a positive error signal on the lead 68 when the flow control signal on the lead 50 is positive and likewise ignores a negative error signal on the lead 68 when the flow control signal on the lead 50 is negative.

The clamp 117 is connected by the lead 73 to the flow comparator 74 in the form of an adder. Power for the flow sensor is supplied via leads 180. The flow feedback signal from the flow sensor 53 is applied by the lead 52 to an inverter/follower 123 which is equivalent to the reversing switch 61 of FIG. 1. A switch 126 is controlled by a shuttle 127 which is operated via the lines 63 and 64 by the pressures in the control chambers 39 and 40 of the main valve 14. The shuttle 127 is disposed in the port plate 100. The switch 126 is connected by leads 129 to the inverter/follower 123 for controlling the latter. The output of the inverter/follower 123 is connected by a lead 124 to a device 125 providing a variable dead band. The output of the device 125 is connected by the lead 62 to the comparator 74.

The output of the flow comparator 74 is connected via the lead 76 to the servo-amplifier 77 whose output is connected via a failsafe clamp 130 and the lead 78 to the force motor 29. As in the previous embodiment, the spool 28 of the pilot valve 27 is biased to its central neutral position by a spring assembly inside the force motor 29. The force motor is selectively energisable in opposite directions to displace the spool 28 to the left or right as required. For this purpose the force motor 29 may be provided with two separate coils or may contain a permanent magnet to enable the displacement direction to be dependent upon the polarity of the energising current. The servo amplifier 77, therefore, has two separate outputs which are selectively operative or has a single output which may be selectively positive or negative.

A fixed throttle 128 is disposed in the port plate 100 and interconnects the lines 63 and 64 to enable the springs 25 and 26 to centre the main valve when the pilot valve 27 is in its neutral position.

A load shunt valve 131 is disposed in a valve block 132 separately attached to the port plate 100. It has two inlet lines 133 and 134 externally connected to the service lines 20 and 21. It has an outlet connected via a fixed bleed throttle 135 and a line 136 to the tank line 23. The load shunt valve 131 has a first operating solenoid 137 by which the valve can be displaced into a position in which the service line 21 is connected via the lines 133 and 136 and the by-pass restriction 135 to tank and a second solenoid 138 which, when energised, connects the service line 20 via the lines 134 and 136 and the by-pass restriction 135 to tank.

For operating the load shunt valve 131 under certain conditions to be later described, a force control mode direction sensor 139 is connected to the output of the window discriminator 113. To inhibit operation of the direction sensor 139 under overrun conditions a bleed inhibit device 140 connects the flow control signal lead 50 to an inhibit input of the force direction sensor 139. The output of the direction sensor 139 is connected via a lead 141 to an amplifier 142 whose output is connected via oppositely poled rectifiers 143 and 144 to the operating solenoids 137 and 138 of the load shunt valve 131. Thus, when the output of the amplifier 142 has one polarity one of the solenoids is operated, and when the amplifier output is of the opposite polarity the other solenoid is energised.

The failsafe clamp 130 is responsive to any one of several different conditions indicative of a fault. Thus, the output of the comparator 74 is connected via a line 145 to an error signal integrator 146 whose output is connected to one input of an OR gate 147. A balanced voltage divider comprising series connected resistors 148 and 149 is connected between a positive terminal 150 and a negative terminal 151. The terminal 150 is connected to the same positive voltage source as the terminals 116 and 121 and the terminal 151 is connected to the same negative voltage source as the terminal 122. The resistors 148 and 149 are chosen so that their central tapping 152 is normally at zero potential. This tapping is connected via an amplifier 153 to a second input of the OR gate 147 whose output is connected via a lead 154 to the failsafe clamp 130.

In the flow control mode of operation of the device of FIG. 3, the force feedback signal on the lead 54 is less in magnitude than the force input signal on the lead 51 and the window discriminator 113 has zero output signal. Under these conditions the clamp 117 allows the flow control signal to pass from the lead 50 to the lead 73 to the flow comparator 74. The flow feedback signal on the lead 52 has a given polarity, e.g. positive and this polarity may be reversed or not reversed by the inverter/follower 123 according to the direction of flow of fluid to the actuator, i.e. according as to whether the fluid is flowing to the actuator in the service line 20 or in the service line 21, the inverter/follower 123 being controlled by the switch 126 which is itself controlled by the shuttle 127 responsively to the difference between the pressures in the control chambers 39 and 40. Due to the nature of the flow sensor 53 there is usually a dead band, i.e. a narrow band of the output signal over which there is no measurable flow. The device 125 serves to eliminate this dead band. The feedback signal in the lead 62, therefore, has a value dependent upon the rate of fluid flow from the actuator, the sensor 53 being inserted in this embodiment in the return line 23, and has a polarity dependent upon the direction of actuator movement. The polarities of the various signals are so chosen that the polarity of the input signal to the flow comparator 74 on the lead 73 is opposite to the polarity of the feedback signal on the lead 62. The output of the flow comparator 74, in the form of an adder, thus constitutes an error signal which is amplifier in the servo-amplifier 77 to control the pilot valve 27 via the force motor 29.

To displace the actuator piston (not shown in FIG. 3) in, say, one direction in the flow control mode, requiring fluid to be supplied to the actuator via the service line 20 and to be returned via the service line 21, the slider 119 is displaced in, say, the positive direction from its zero position so that a positive control signal, i.e. a signal which is positive relative to a null value, is applied via leads 50 and 73 to the flow comparator 74. Initially there is no flow feedback signal on the lead 62 so that a positive error signal appears on the lead 76 and is amplified by the servo-amplifier 77 to energize the force motor 29 to displace the pilot spool to the right. Pilot pressure is thereby applied to the control chamber 40 of the main valve 14 to displace the main valve spool 24 to the left, thus controllably connecting the supply line 22 to the service line 20 and the service line 21 to the return line 23. The resulting fluid flow in the flow sensor 53 causes a feedback signal to appear on the lead 52 and the shuttle 127 responding to the pressure in the control chamber 40 greater than that in the control chamber 39 operates the inverter/follower 123 via the switch 126 to invert the flow feedback signal, so that the feedback signal on the lead 62 to the flow comparator 74 is of negative polarity in order to diminish the positive error signal applied to the servo-amplifier 77 until the steady state is reached. If the positive control signal is reduced in magnitude by displacing the slider 119 towards its zero position at the centre of the potentiometer 120, the resulting error signal of negative polarity on the lead 76 reverses the pilot valve 27 until the main spool has been displaced towards its neutral position to conform to the new flow requirement and a return to the steady state has been achieved. To displace the actuator piston in the opposite direction in which fluid is supplied via the service line 21 and returned via the service line 20, the slider 119 is displaced below the centre of the potentiometer 120 to apply to the lead 73 a negative control signal, i.e. a signal which is negative relative to the null value. In this case the shuttle 127 operates the inverter/follower 123 via the switch 126 to make the feedback signal on the lead 62 of positive polarity whereby a negative error signal initially appears in the lead 76 until the steady state is reached.

The outputs of the pressure transducers 55 and 56 are of opposite polarity so that these outputs can be added together on the potentiometer 59 to obtain on the tapping 60 a feedback signal dependent upon the difference between the pressures in the service lines 20 and 21. The slider 60 can be readily adjusted to compensate for unsymmetry of the hydraulic actuator whereby the feedback signal represents the force applied by or to the actuator. When the pressure in the line 20 exceeds that in the line 21 the force feedback signal on the lead 54 is of positive polarity and vice versa. As previously mentioned, the magnitude of the force feedback signal is less than the magnitude of the force control signal on the lead 51 when operating in the flow control mode.

To operate the device in the force control mode the slider 119 of the potentiometer 120 is adjusted in a positive or negative direction to determine the direction of actuator movement. The slider 114 of the potentiometer 115 is adjusted to the desired nominal actuator force. When operating in the force control mode or when operating with maximum force override in the flow control mode, the feedback signal on the lead 54 between the tapping 60 and the discriminator 113 has a potential higher in magnitude than the potential of the force control signal on the lead 51. The window discriminator 113 then produces an error signal on the lead 68 connected to the clamp 117 and this error signal is negative or positive depending upon which of the pressures in the service lines 20 and 21 is the higher. Normally the polarity of the error signal on the lead 68 is opposite to that of the flow control signal on the lead 50. Thus, if the flow control signal on the lead 50 is positive so that fluid is supplied via the service line 20 and returns via the service line 21, the pressure in the line 20 exceeds the pressure in the line 21 and the force feedback signal on the lead 54 is of positive polarity, unless the load is overrunning the actuator. Consequently in this case the error signal on the lead 68 is negative to reduce the magnitude of the signal on the lead 73. The fluid flow to the actuator is thereby reduced, so tending to relieve the load on the actuator and to reduce the pressure feedback signal until the steady state is reached. If the flow control signal on the lead 50 is negative, fluid flows to the actuator via the line 21 and returns via the line 20. Unless the load is overrunning the actuator, the pressure in the line 21 exceeds that in the line 20 so that the force feedback signal on the lead 54 is of negative polarity and the error signal on the lead 68 is positive.

The device of FIG. 3 may be used for the flow control of a load overrunning the actuator. If fluid is flowing to the actuator via the service line 20 and is returning via the service line 21 and the load is overrunning the actuator, the pressure in the line 21 exceeds that in the line 20, whereby the flow control signal on the lead 50 and the error signal on the lead 68 are both positive. In this case the clamp 117 ignores or suppresses the force error signal on the lead 68 and continues to pass the flow control signal on the lead 50 directly to the lead 73. The same is true for a negative flow control signal on the lead 50 when the load is overrunning the actuator. Otherwise the force feedback signal might tend to increase the magnitude of the signal on the lead 73 and lead to instability. Thus there is no force limitation by means of the device of FIG. 3 when operating with an overrunning load.

FIG. 4 shows the window discriminator 113 and the clamp 117 in more detail. The discriminator 113 comprises two operational amplifiers 155 and 156. The force control signal input lead 51 is connected directly to a first input of the amplifier 155 and via an inverter 157 to a first input of the amplifier 156. The lead 54 from the tapping 60 of the potentiometer 59 is connected directly to the second inputs of the two operational amplifiers 155 and 156. The lead 68 illustrated diagrammatically in FIG. 3 is constituted by two separate leads 159 and 160 connected to the outputs of the operational amplifiers 155 and 156, so that any negative going error signal appears on the lead 159 and any positive going error signal appears on the lead 160.

The clamp 117 comprises oppositely poled diodes 161 and 162 connected respectively between the lead 159 or 160 and a junction 163 connected to earth or zero potential. The clamp 117 also includes oppositely poled compensating diodes 164 and 165 connected respectively between the lead 159 or 160 and a junction 166 to which the lead 73 is connected. The flow control signal lead 50 is connected to the junction 166 via a resistor 118.

The operational amplifiers 155 and 156 are constructed as triggers. In the untriggered state of the amplifier 155 in which any force feedback signal on the lead 54 is less positive than the force control signal on the lead 51, the potential on the output lead 159 is at a fixed positive value higher than the maximum positive potential to which the slider 119 of the flow control potentiometer can be adjusted, thereby blocking the diodes 161 and 164. Likewise in the untriggered state of the amplifier 156 in which any force feedback signal on the lead 54 is less negative than the inverted force control signal on the lead 158, the potential on the output lead 160 is at a fixed negative value more negative than the maximum negative potential to which the slider 119 can be adjusted, thereby blocking the diodes 162 and 165. The potential on the junction 166 is thereby able to follow the potential on the lead 50.

When the force feedback signal on the lead 54 becomes more positive than the force control signal on the lead 51, the operational amplifier 155 is triggered and the resulting negative going error signal at the amplifier output rapidly reduces the potential of the lead 159 from the fixed positive value, which potential can in the limit become negative causing the diode 163 to conduct. When the potential on the lead 159 becomes less positive than the potential on the flow control signal lead 50, the diode 164 is opened whereby the potential on the junction 166 follows the potential on the lead 159 towards zero instead of the potential on the lead 50.

Likewise when the force feedback signal on the lead 54 becomes more negative than the inverted force control signal on the lead 158, the operational amplifier 156 is triggered, thereby rapidly making the potential on the lead 160 less negative than the fixed negative value. As soon as the latter potential becomes less negative than that on the lead 50, the diode 165 is opened whereby the potential on the junction 166 follows that on the lead 160 towards zero.

The resistor 118 prevents the tapping 119 from being short-circuited to earth via the diode 164 or 165. The diode 164 provides a voltage drop to compensate for the voltage drop across the diode 161 so preventing the junction 166 from becoming negative when the tapping 119 is positive. The diode 165 likewise compensates for the voltage drop across the diode 162.

At maximum negative error signal output of the amplifier 155 the junction 166 is clamped at zero potential in that it cannot then have a positive potential, but it could have a negative potential. Likewise at maximum positive error signal output of the amplifier 156 the junction 166 cannot becomes negative but may be positive. Thus with an overrunning load a positive error signal on the lead 160 cannot prevent a positive flow control signal being applied via the lead 50 to the junction 166 and thence via the lead 73 to the comparator 74 and a negative error signal on the lead 159 cannot prevent a negative flow control signal being applied via the lead 50 to the junction 166. The clamp 117 thereby ignores or suppresses any error signal arising from the force feedback signal when operating the device in the flow control mode to control an overrunning load.

As shown in FIG. 4, the adder forming the comparator 74 comprises series connected resistors 167 and 168 between the leads 73 and 62, the lead 76 being connected to the junction between the resistors. The signal on the lead 76 represents the difference between the magnitudes of the signals on the leads 73 and 62.

The graph of FIG. 2 will substantially apply also to the embodiment of FIGS. 3 and 4. The slope of the force limiting lines 81, 84, 86 and 89 is determined mainly by the gain of the operational amplifiers 155 and 156. A steep slope corresponding to a high gain is desirable in order that the device can be used to accurately control actuator force but the slope should not be too steep if hunting is to be avoided.

It will be seen that the main valve 14 controls fluid flow to and from the actuator whether the device is operating in the flow control mode or the force control mode. In other words the force control cuts back the flow along one of the near vertical lines such as 81, 84, 86 or 89 in order to effect force control. If the load is stationary in the force control mode there is no fluid flow to and from the actuator. If the main valve 14 were to adopt its neutral position in conformity therewith, there would be no fluid flow to control and the device could not control the actuator force in the force control mode. This condition would be represented by a maximum force error signal on the lead 68 clamping the signal on the lead 73 to zero which matches a zero flow feedback signal on the lead 62, whereby the pilot valve 27 and the main valve 14 remain unactuated despite the existence of the force error signal. The load shunt valve 131 and the bleed throttle 135 are provided to permit fluid flow through the main valve 14 when the actuator is stationary in the flow control mode, thereby enabling the device to control the pressure difference between the lines 20 and 21 and thereby the load on the actuator in the force control mode.

As shown in FIG. 4, the force control mode direction sensor 139 is connected to the leads 159 and 160 from the window discriminator 113 and responds to a maximum error signal on either of the leads 159 and 160 to give a corresponding output signal on the lead 141, e.g. a negative signal when a maximum negative error signal appears on the lead 159 and a positive signal when a maximum positive error signal appears on the lead 160. The maximum negative error signal is represented by the lead 159 going slightly negative due to the voltage drop across the conducting diode 161 and the maximum positive error signal is represented by the lead 160 going slightly positive due to the voltage drop across the conducting diode 162. The signal on the lead 141 is amplified in the amplifier 142 and a positive signal is passed via the diode 143 to the solenoid 137 whilst a negative signal is passed via the diode 144 to the solenoid 138.

Thus a high pressure in the service line 20 when the load is stationary causes the solenoid 138 to be energized to connect line 20 to drain via the bleed throttle 135. The pressure in the line 20 is thereby relieved to reduce the force error signal in the line 68 and thereby provide an input signal on the line 73 to the flow comparator 74 in order to displace the main valve spool 24 to a steady state position in which it permits fluid to flow from the supply line 22 to the service line 20 to make up for the fluid flowing through the bleed throttle 135. Likewise a high pressure in the service line 21 when the load is stationary actuates the solenoid 137 to connect the line 21 to drain via the bleed throttle 135.

A maximum force error signal on the lead 68 can also occur when the device is operating in the flow control mode with an overrunning load. To prevent the load shunt valve 131 from being operated under such circumstances, the bleed inhibit device 140 applies the flow control signal on the lead 50 to the inhibit input of the direction sensor 139. The polarity of the signal on the lead 50 is indicative of the direction of actuator movement and the polarity of the error signal on the lead 68 is indicative of the direction of the load on the actuator. If these signals are of opposite polarity an appropriate signal can appear on the lead 141. If they are of the same polarity the load is overrunning the actuator and no signal can reach the lead 141.

In operation of the device, the error signal on the lead 76 should always tend to decay. A likely result of a fault in the circuitry is that the error signal on the lead 76 builds up thus setting the main valve 14 wide open. The error signal integrator 146 detects such a condition by integrating the error signal with respect to time. Should the integrated error signal build up to a significant value the integrator 146 applies a signal via the OR gate 147 to the failsafe clamp 130 which thereby removes any signal from the lead 73 enabling the pilot valve 27 to close under its centering spring bias. The main valve 14 is likewise closed by one or other of the springs 25 and 26 because the fixed throttle 128 allows the pressures in the chambers 39 and 40 to equalize when the pilot valve ports 35 and 36 are closed. The actuator is thereby stopped.

Should one of the positive and negative voltage sources applied to the terminals 116, 121 and 122 fail, the voltage divider 148, 149 is unbalanced so that a signal is applied to the amplifier 153. The resulting output signal from the amplifier 153 is passed via the OR gate 147 to the failsafe clamp 130 to stop the actuator as described above.

In the embodiment of FIGS. 3 and 4 the load shunt valve 131 may be arranged to interconnect the service lines via the bleed throttle 135 instead of connecting one of these lines via the bleed throttle. In this case the load shunt valve need only be a two position valve as it no longer matters which of the service lines is at the higher pressure. Only one operating solenoid 137 or 138 is then required and the diodes 143 and 144 are omitted.

Alternative arrangements are possible within the scope of the invention. The flow sensor 53 may be in the supply line 22 as shown in FIG. 1 or it may be in the return line 23 as shown in FIG. 3. Another possibility is for the flow sensor 53 to be arranged in one of the service lines 20 and 21. In this last case the reversing switch 61 of FIG. 1 or the inverter/follower 123 and shuttle 127 of FIG. 3 can be omitted since the polarity of the signal from the flow sensor will be automatically reversed when the flow direction to the actuator is reversed. Reference may be made to copending U.S.A. patent application Ser. No. 412,024 filed by one of the present applicants on Nov. 1, 1973 for a description of the circumstances in which the different arrangements of the flow sensor may be preferred.

If in the embodiment of FIG. 3 the flow sensor is to be in one of the service lines, the lines 22 and 23 are made the service lines and the lines 20 and 21 are made the supply and return valves. The pressure transducers 55 and 56 are then connected to the lines 22 and 23 instead of the lines 20 and 21. The external connections to the load shunt valve 131 also have to be changed.

The modular construction of the device shown in FIG. 3 is thereby very adaptable to different kinds of use, the only internal changes within any of the valve blocks 101,110 and 132 and the port plates 100 and 103 being the alternative connections of the pressure transducers.

Several embodiments of flow sensor are described in Keerie et al. U.S. application Ser. No. 512,491 filed concurrently herewith and having a common assignee with the present patent application. In such flow sensors a pivoted flap is displaced against spring means by the fluid flow to be measured and this displacement is used to move the slider of a potentiometer. The flow sensor is preferably so constructed and dimensioned that the electrical output signal is directly proportional to the fluid flow through the sensor. One such flow sensor is shown in FIGS. 5 to 9 of the drawings. Referring to FIG. 5, there is shown a port plate 219 in the form of a rectangular block. This block has four through passages or ports 220, 221, 222 and 223 arranged relatively to one another in accordance with the "CETOP"standard and corresponding to the lines 20, 21, 22 and 23 of FIGS. 1 and 3. The port plate 219 has additional holes or through bores 225 enabling the port plate to be attached to other blocks, such as valve blocks.

For the purpose of measuring the rate of fluid flow through the passage 222 flow sensor 53 is inserted into a bore 226 forming an access opening in the port plate 219 from a side face 227 thereof. The axis 228 of the bore 226 is perpendicular to the axis 229 of the passage 222. The bore 226 intersects the passage 222 but the axes 228 and 229 do not intersect. This is shown more clearly in FIG. 9 of the drawings.

The flow sensor 53 as shown in FIGS. 6 to 9 of the drawings comprises a vane 280 secured to a spindle 281 journalled in a housing 282. This vane 280 cooperates with a shelf 283 projecting partially into the flow passage 222. In the mid-position of the vane 280 illustrated in the drawings the flow passage is effectively closed or obturated. The flow of fluid through the passage 222 in one direction or the other displaces the vane 280 clockwise or anti-clockwise against the force of a torsion spring 285. The spindle 281 is coupled to the slider of a rotary potentiometer 286 to displace the slider to the left or right of its mid-position. A constant supply voltage is applied between terminals 287 and 288 and the voltage on the slider appears at a terminal 289 as the flow feedback signal. The torsion spring 285, the potentiometer 286, the vane 280, and the shelf 283 can be designed so that the signal appearing at the terminal 289 is proportional to the rate of fluid flow through the passage 222.

The housing 282 is closed by a cover 230 formed with a flange 231 and provided with a sealing ring 232 to enable the housing to be secured in position inside the bore 226 by means of screws 233 and sealed to this bore. A small opening 234 in the cover 230 provides access to the terminals 287, 288 and 289. It will be seen from FIG. 9 that the shelf 283 is integral with the port plate 219. The passage or port 222 can be formed by drilling from opposite faces 235 and 236 of the port plate towards the centre thereof to leave a thin web and then by drilling the bore 226 from the side face 227 so as to break into the two previous borings as this web whereby to remove a part of the web, so leaving the shelf 283.

The flow sensors, instead of being provided with potentiometers as mechanical/electrical transducers, may be provided with variable resistance carbon piles. Alternatively, an inductive transducer may be employed.

Various forms of pressure transducers may also be employed, for example, each may comprise a pressure actuated diaphragm which operates a slider of a potentiometer or a variable resistance pile or an inductive transducer.

In place of the potentiometer 59 a simple variable resistor in one of the leads 57 and 58 may be employed, preferably in the lead appertaining to the larger piston area. The lead 58 is thus, for example, connected directly to the lead 54 whilst the lead 57 is connected via the variable resistor to the lead 54.

Whilst the drawings illustrate a double-acting force motor 29 disposed at one end of the pilot valve 27, the force motor 29 can be replaced by two single-acting solenoids placed at opposite ends of the pilot valve 27 for displacing the spool 28 in opposite directions from its central neutral position.

We claim:

1. In combination with hydraulic actuator means, a device for controlling the flow of fluid to said hydraulic actuator means, said device comprising a fluid pressure operated main valve for regulating the fluid flow to the actuator means; via service lines a pilot valve for controlling the main valve, via control lines said pilot valve including electrical operating means; electrical input means for an electrical input signal; flow sensing means for producing an electrical feedback signal dependent on the rate of fluid flow to the actuator means, said flow sensing means including a pivoted movable element displaceable from a closed flow blocking position in accordance with the fluid flow to be sensed and biased into said position by spring means and mechanical/electrical transducer means for converting such displacement into said feedback signal; and means for comparing said feedback signal with said input signal to produce an electrical error signal for said electrical operating means to operate said pilot valve in accordance with such comparison.

2. A device according to claim 1 in which said input and feedback signals are of opposite polarity and said comparing means comprises an adder.

3. A device according to claim 2 in which said adder comprises a series arrangement of two resistors and further comprising means connecting the ends of said series arrangement respectively to said flow sensing means and said electrical input means, and means for connecting the junction of said two resistors to said electrical operating means of said pilot valve.

4. A device according to claim 1 in which a high gain amplifier is provided for amplifying said error signal, the output of such amplifier being applied to said electrical operating means of said pilot valve.

5. A device according to claim 1 which further comprises second electrical input means for a second electrical input signal, pressure sensing means for producing a second electrical feedback signal responsively to the pressure difference across said actuator means and thereby dependently upon the load on the actuator means, and means for comparing said second feedback signal with said second input signal to operate said pilot valve in accordance with such comparison.

6. A device according to claim 5 in which said pressure sensing means comprises two pressure transducers, said main valve having two service ports connected to respective sides of the actuator means, said pressure transducers being responsive to the pressures in said service ports.

7. A device according to claim 6 including means for processing the output signals from the top transducers unsymmetrically in order that the electrical feedback signal can take into account unsymmetry of said hydraulic actuator means.

8. A device according to claim 7 in which said means for processing the pressure transducer output signals comprises a potentiometer connected to receive at its opposite ends opposite polarity output signals from said pressure transducers.

9. A device according to claim 5 in which said means for comparing said second feedback and second input signals comprises an adder at whose output appears a force error signal for controlling the pilot valve.

10. A device according to claim 9 which further comprises means for suppressing a force error signal indicative of said second feedback signal being less in magnitude than said second input signal and an adder for adding any unsuppressed force error signal to said first-mentioned electrical input signal.

11. A device according to claim 5 which said means for comparing said second feedback and second input signals comprises a window discriminator adapted to produce a force error signal only when the second feedback signal exceeds the second input signal.

12. A device according to claim 11 in which said window discriminator comprises two operational amplifiers each having two inputs and an output and means are provided to connect said second electrical input means in opposite senses to one input of each of said operational amplifiers and to connect said pressure sensing means to the other input of each of said operational amplifiers, one or other of the operational amplifiers producing an error signal of respective polarity according to the polarity of said second feedback signal when the latter exceeds the second input signal in magnitude.

13. A device according to claim 11 which further comprises clamp means connecting said first-mentioned electrical input means to said first-mentioned comparing means, said clamp means being controlled by the output of said window discriminator to apply any force error signal to said first comparing means instead of said first-mentioned electrical input signal.

14. A device according to claim 13 which said clamp means is adapted to reject any force error signal of opposite polarity to said first electrical input signal.

15. A device according to claim 14 in which said clamp means comprises two series circuits connected in parallel to receive force error signals of opposite polarity at opposite ends of such series circuits, one series circuit comprising two diodes whose junction is connected to earth and the other series circuit comprising two diodes whose junction is connected to said first-mentioned comparing means and in which a resistor is provided to connect said first-mentioned electrical input means to the last-mentioned junction.

16. A device according to claim 11 which further comprises load shunt valve means having electrical operating means therefor, inhibit means connecting the output of said window discriminator to said electrical operating means of said load shunt valve, said inhibit means having an inhibit input, and means connecting said first mentioned electrical input means to said inhibit input to inhibit operation of said load shunt valve means except when the magnitude of said first mentioned input signal is at least substantially zero.

17. A device according to claim 1 which further comprises a failsafe clamp for preventing said first-mentioned error signal reaching said pilot valve and an error signal integrator for integrating said first-mentioned error signal to operate said failsafe clamp in the event that such error signal does not decay.

18. A device according to claim 17 further comprising means responsive to a partial power failure for operating said failsafe clamp.

19. A device according to claim 1 in which said electrical input signal means includes means for varying said electrical input signal in opposite directions from a null value to determine the direction of operation of said main valve.

20. A device according to claim 1 which comprises respective valve blocks in which said main and pilot valves are respectively disposed.

21. A device according to claim 20 further comprising a port plate between said main and pilot blocks and a pressure reducing valve in said port plate and serving to provide pilot fluid for the pilot valve.

22. A device according to claim 20 further comprising a port plate on which the main valve block is mounted, said flow sensing means being disposed in said port plate.

23. A device according to claim 1 in which the flow sensing means is installed in one of the supply and return lines to the main valve and in which switch means responsive to the direction of fluid flow in said control lines to said hydraulic actuator means from the pilot valve and the main valve are provided for determining the polarity of said first mentioned electrical feedback signal.

24. A device according to claim 23 in which said switch means is pressure operated by the pilot valve output.

25. In combination with hydraulic actuator means, a device for controlling the flow of fluid to said hydraulic actuator means, said device comprising a fluid pressure operated main valve for regulating the fluid flow to the actuator means via service lines; a pilot valve for controlling the main valve via control lines, said pilot valve including electrical operating means; electrical input means for an electrical input signal; flow sensing means for producing an electrical feedback signal dependent on the rate of fluid flow to the actuator means, said flow sensing means including a pivoted movable element displaceable from a closed flow blocking in accordance with the fluid flow to be sensed and biased onto said position by biasing means and mechanical-/electrical transducer means for converting such displacement into said feedback signal; and means for comparing said feedback signal with said input signal to produce an electrical error signal for said electrical operating means to operate said pilot valve in accordance with such comparison, said input and feedback signals being of opposite polarity and said comparing means comprising an adder; a failsafe clamp for preventing said first-mentioned error signal reaching said pilot valve and an error signal integrator for integrating said first-mentioned error signal to operate said failsafe clamp in the event that such error signal does not decay; said electrical input signal means including means for varying said electrical input signal in opposite directions from a null value to determine the direction of operation of said main valve, said flow sensing means being installed in one of the supply and return lines to the main valve and switch means being responsive to the direction of fluid flow in said control lines from the pilot valve to the main valve being provided for determining the polarity of said first-mentioned electrical feedback signal.

* * * * *